US005494204A

United States Patent [19]

Wang

[11] Patent Number: 5,494,204

[45] Date of Patent: Feb. 27, 1996

[54] STAND FOR EASY REPLACEMENT OF THE TAPE ROLL

[76] Inventor: Shenn-Ming S. Wang, 3C. No. 60, Sec. 2, Tun-Hwa S. Rd., Taipei, Taiwan

[21] Appl. No.: 196,379

[22] Filed: Feb. 15, 1994

[51] Int. Cl.[6] ..... B26F 3/02; B65D 21/028

[52] U.S. Cl. ..... 225/25; 225/38; 225/42; 225/47; 206/394; 220/23.4; 242/605; 242/608.6

[58] Field of Search ..... 225/38, 25, 34, 225/37, 42, 44, 46, 47, 77; 242/55.3, 55.42, 603, 605, 608.5, 608.6; 206/391, 394, 509, 511; 220/23.4

[56] References Cited

U.S. PATENT DOCUMENTS

| | | | |
|---|---|---|---|
| 2,494,106 | 1/1950 | Rengo | 225/38 X |
| 2,656,131 | 10/1953 | Johnson | 225/38 X |
| 2,834,507 | 5/1958 | Metzler et al. | 242/55.42 X |
| 3,502,252 | 3/1970 | Mariani | 225/38 X |
| 4,527,722 | 7/1985 | Strachan | 225/34 X |
| 5,123,582 | 6/1992 | Lo | 225/38 X |
| 5,154,336 | 10/1992 | Oueller | 225/38 |

*Primary Examiner*—Rinaldi I. Rada
*Assistant Examiner*—Clark F. Dexter
*Attorney, Agent, or Firm*—Bucknam and Archer

[57] ABSTRACT

An interconnecting structure for connectable tape stands formed with a plurality of resilient fingers extending axially from the free end of a hollow cylinder which extends from the inner face of a side wall, and the free ends of the resilient fingers being formed with radially outwardly facing flanges. Through holes penetrating onto the wall of the supporting cylinder are formed in alignment with the resilient fingers on the outer face of the side wall. As a result, when the resilient fingers of one tape stand are inserted into the corresponding through holes on another tape stand, the flanges on the respective resilient fingers will enter the through holes and rest on the inner face of the side wall, thus to complete the interconnection of the tape stands. In addition, grooves are formed axially inwardly in the hollow cylinder on both sides of the resilient fingers for increasing the flexibility of the resilient fingers such that a tape roll is easy to replace.

6 Claims, 4 Drawing Sheets

STAND FOR EASY REPLACEMENT OF THE TAPE ROLL

FIELD OF THE INVENTION

The present invention relates to an interconnecting structure for use in connectable and easy tape replacement tape stands which are axially formed with a plurality of resilient fingers on the free end of a hollow cylinder extending from a side wall for supporting the tape roll, the free ends of the resilient fingers being formed with radially outwardly facing small arcuate projections. Axial slots penetrating into the wall of the cylinder are formed opposite the registered resilient fingers through the outer face of the side wall. As a result, by inserting the resilient fingers of one tape stand into the slots on another adjacent tape stand, the two tape stands can be connected together. In addition, grooves of suitable depth are formed into the hollow cylinder along both sides of the resilient fingers for increasing the flexibility of the resilient fingers such that the tape roll is easy to replace.

BACKGROUND OF THE INVENTION

Tape stands installed with tape rolls of different widths and in different colors connected together for easy selection of the different color tapes are known such as that disclosed in U.S. Pat. No. 5,123,582. In this patent, the side walls of the tape stands are connected by a glue-fixed member located, between the front ends of said side walls. The other ends of the side walls are supported on a flexible and spreadable support ring for loading a tape roll on the side walls. The support ring on one of the side walls is projected toward the outer face of the side walls into a ring tenon, and a ring mortise of an inner diameter mating with the outer diameter of the ring tenon is formed on the outer face of the other side wall supporting the ring. In this manner, by inserting the ring tenon on one tape stand into the corresponding ring mortise on another tape stand, connection of a plurality of tape stands can be performed.

In such a structure, adjacent tape stands are held in connected relation only by the friction force between the ring mortise and the ring tenon. In practice, however, the friction force between the ring mortise and the ring tenon can hardly be controlled to be constant due to manufacturing tolerance of the ring mortise and the ring tenon, the wear resulting from long time use, the attendant wear of the molds after mass production, and even the inconsistency of the plastic materials for producing the tape stands. Even when new products for which good connection can be maintained between adjacent tape stands are used, the adjacent stands, become loose easily and do not remain connected after having been used for a period of time.

SUMMARY OF THE INVENTION

In view of the above disadvantages, an object of the present invention is to provide a dependable semi-snail shaped structure for interconnecting tape stands wherein a plurality of resilient fingers are axially formed on the free ends of a hollow supporting cylinder for carrying a tape roll, and small arcuate projections are formed radially outwardly on the free ends of the resilient fingers. In addition, slots penetrating tile wall thickness of the supporting cylinder are formed at the position of the registered resilient fingers on the outer face for securing this supporting cylinder. In this manner, when the resilient fingers on one tape stand are inserted into the corresponding slots on another tape stand, the small arcuate projections on respective resilient fingers will rest on the inner face of the side wall such that the two tape stands can be integrally connected.

Another object of the present invention is to provide such a connecting structure with which no relative rotation will occur between the connected tape stands, because each of the resilient fingers is restrained in a slot of a width corresponding to that of the resilient fingers. Still another object of the present invention is to provide such a connecting structure wherein the small projections of the resilient fingers are formed into the shape of a triangle or an arc so as to ensure that the two tape stands will not lossen accidentally on the one hand and that the stands can be disconnected under a suitable pulling force on the other hand.

Yet another object of the present invention is to provide such a connecting structure wherein axially inwardly facing grooves are formed at a place where both sides of the resilient fingers land the free ends of the supporting cylinder are connected such that the tape roll can be easily removed from tile supporting cylinder for replacement.

The above and other objects and functions of the present invention can be better understood from the following description of a preferred embodiment in conjunction with the accompanying drawings in which:

DETAILED DESCRIPTION OF THE INVENTION

Figure 1:
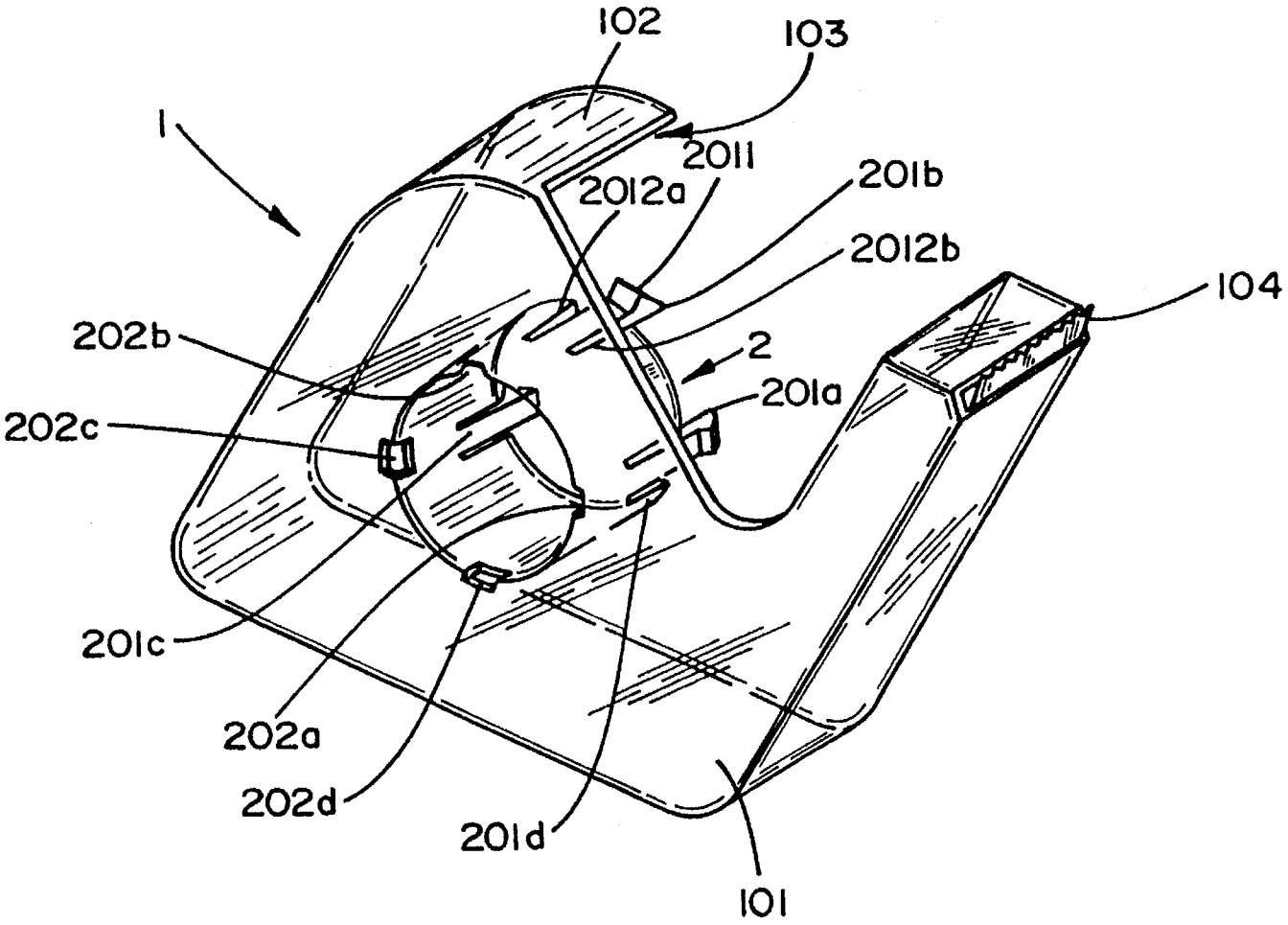
FIG. 1 is a perspective view of a semi-snail shaped tape stand of the present invention.

First referring to FIG. 1, there is shown a semi-snail shaped tape stand 1 of the present invention comprising a side wall 101, one side of said side wall 101 being surrounded by a protective wall 102 of a height corresponding to that of the tape roll carried thereon, and the top of the protective wall together with the side wall 101 is cut out to form into a diagonal opening 103 such that the end of the tape roll can be pulled out therethrough and cut off by a serrated blade 104 fixed on the top right portion of the protective wall.

Figure 3:
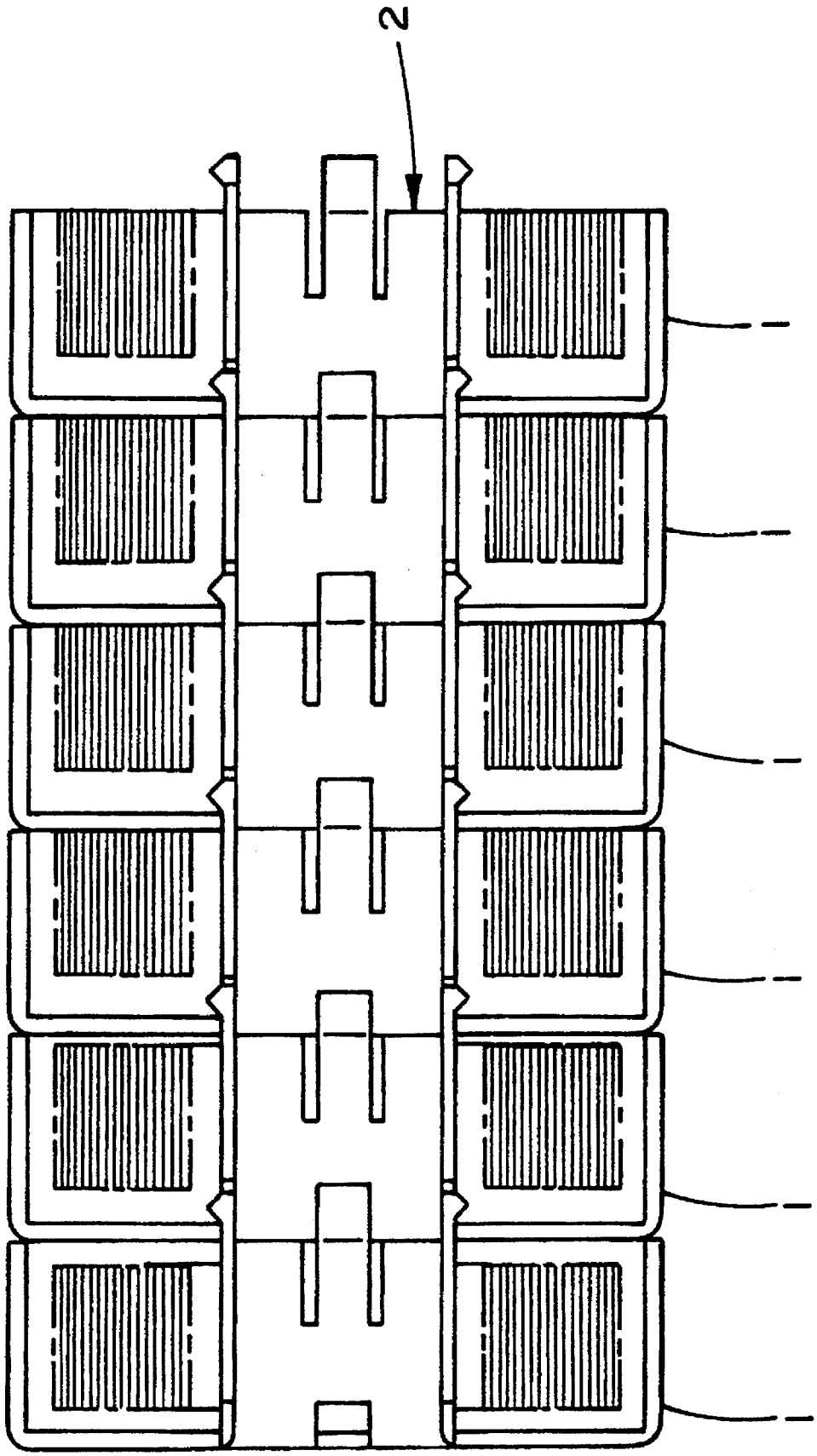
FIG. 3 is a cross section view as seen from above in FIG. 2 showing the relative position between respective connecting structures of adjacent tape stands.
Figure 4:
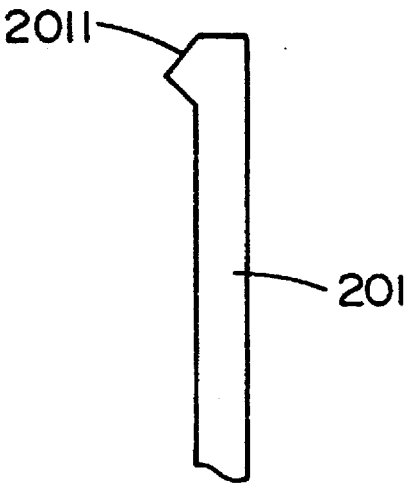
FIGS. 4 and 5 are side views of one of the resilient fingers showing alternate configurations of the flange.
Figure 5:
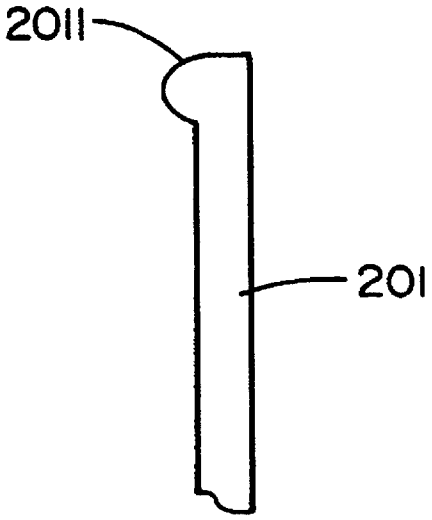

A hollow tape roll supporting cylinder 2 is formed rightwardly on the end face on the same side of the side wall 101 as the protective wall 102. This supporting cylinder 2 has a height corresponding to that of the protective wall 102. As shown in FIGS. 1 and 3, a plurality of axially extending resilient fingers 201*a, b, c, d* are formed at equal spacings along the circumferential face on the free end of the supporting cylinder 2. A flange 2011 which may be in the shape of a triangle or an arc (FIG. 5) is formed radially outwardly on the free end of these resilient fingers (represented by 201*b* for purpose of description); and grooves 2012*a, b* of suitable depth are formed in the cylinder wall adjacent the end of the base portion of the resilient fingers connected to the supporting cylinder along both sides of the resilient fingers in order to increase the flexibility of the resilient fingers.

In addition, slots 202*a, b, c, d* having a width slightly larger than the width of the resilient fingers and a depth from the outer face of the side wall larger than the height of the resilient fingers and penetrating the wall of the supporting cylinder are formed at the end of the supporting cylinder 2 connected to the side wall corresponding to each of the resilient fingers 201*a, b, c, d* in a direction from the outer face of the side wall 101 to the supporting cylinder.

Figure 2:
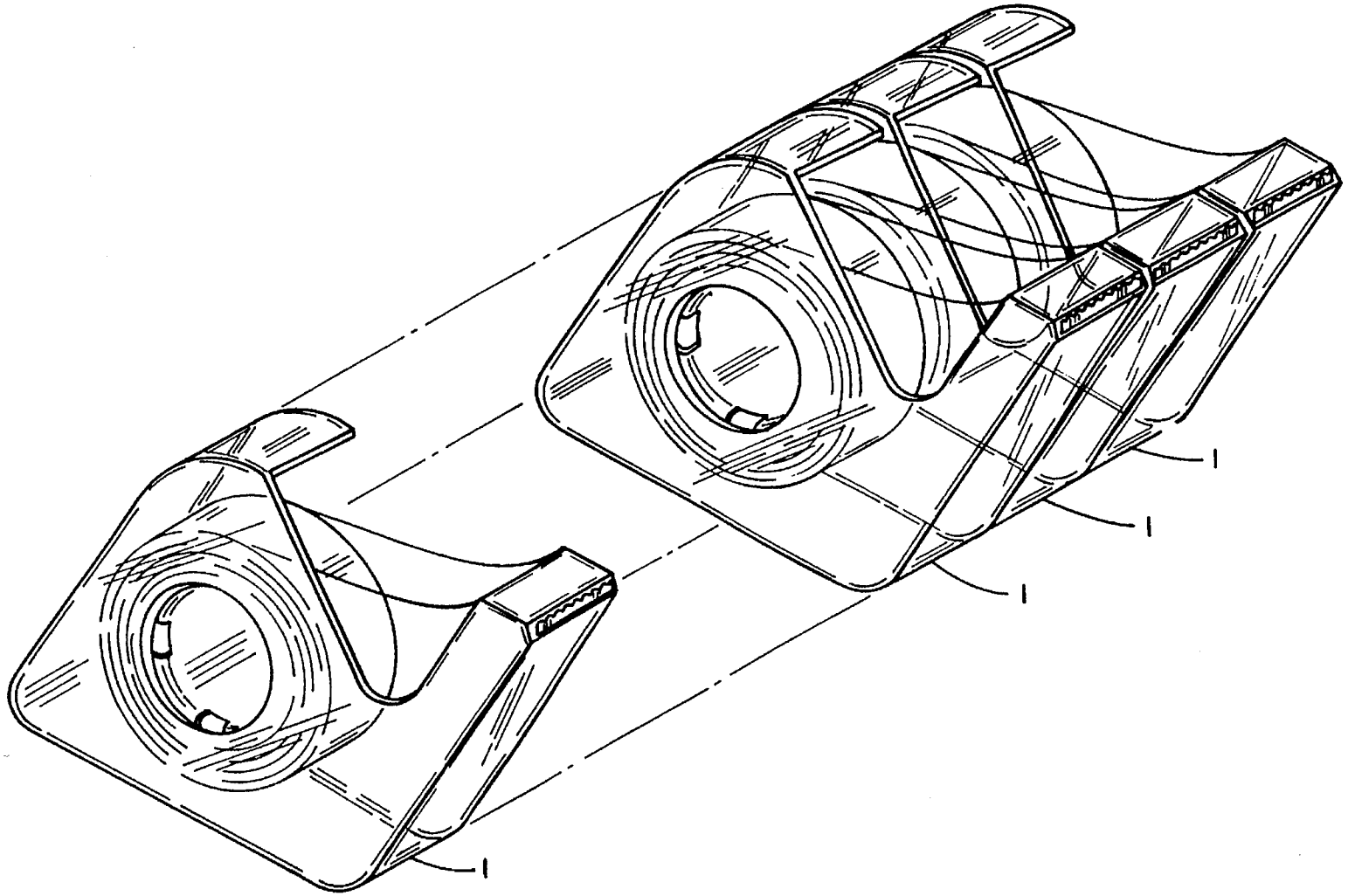
FIG. 2 is a schematic perspective view showing a number of tape stands as shown in FIG. 1 being interconnected wherein each of the tape stands is installed with a tape in a different color.

According to the present invention, when the tape stands are connected together as shown in FIGS. 2 and 3 of the resilient fingers of the hollow supporting cylinder 2 in a tape stand are registered with and inserted into the respective slots on the side of another tape stand away from an adjacent tape stand. Due to the guiding action provided by the flanges of the one tape stand on respective resilient fingers, the slightly spread out resilient fingers are normally blocked by the edge of the through groove opening and forced to close relative to each other, thus to slide in easily until these flanges pass through the thickness of the side walls of the adjacent tape stand. Then the resilient fingers are not restrained and can spring open in the slots with a shoulder on the bottom of the flanges abutting against the inner face of the side wall. In this manner, a plurality of tape stands can be connected together wherein respective resilient fingers are restrained in respective slots without relative rotation occurring between the tape stands.

On the contrary, when the tape stands are disconnected, force is exerted axially on one tape stand such that the flanges resting on the side wall are subject to inwardly pressing force. If excessive axial force is exerted, the flanges can be axial force is exerted, the flanges will be moved inwardly until they can be moved out of the slots so that they are disconnected from the adjacent tape stand.

It is noted that with the present invention when the tape roll carried on the supporting cylinder is to be replaced, since the slots 2012*a, b*, are formed on both sides at the bottom end of respective resilient fingers increasing the length of the resilient fingers, their flexibility is increased. Therefore, when the tape roll is removed from the supporting cylinder or a new tape roll is installed thereon, the normally slightly spread out resilient fingers are easy to close radially inwardly such that it is easy to remove the tape roll from the supporting cylinder or to reinstall a new tape roll.

From the foregoing, it can be seen that a simple and secure interconnecting structure for semi-snail tape stands is provided which exhibits novelty and technical improvements and achieves said objects.

I claim:

1. A connectable tape stand of semi-snail shape, for easy replacement of the tape roll carried thereon, comprising a side wall (101), said side wall having a first side, an opposite side, a periphery and a thickness, a protective wall (102) extending around said periphery of said side wall and extending orthogonically from said first side, said protective wall having a free end and a height wherein said height is measured from said first side of said side wall to said free end of said protective wall, said protective wall having a top including a first corner and an opposite corner, said top of said protective wall together with said side wall (101) being cut out to form an opening (103) between said corners, a portion of said opening forming a diagonal surface in said side wall, a serrated cutter (104) located at said opposite corner of said protective wall; a hollow supporting cylinder (2) for supporting a tape roll, said supporting cylinder protruding from said first side of said side wall; said supporting cylinder having a free end and a height wherein said height is measured from said first side of said side wall to said free end of said cylinder, said height of said cylinder being the same as the height of said protective wall, a plurality of resilient fingers (201*a,b,c,d*) extending axially from said free end of said supporting cylinder and having a base portion, a free end, a width and a length, flanges (2011) being formed radially outwardly with respect to said supporting cylinder on said free end of each of said resilient fingers, slots (202*a,b,c,d*) penetrating axially into a wall of said supporting cylinder from said opposite side of said side wall and having a circumferential width slightly larger than the width of each of said resilient fingers for insertion of each resilient finger and its flange into a corresponding one of said slots, said base portion of said resilient fingers having an end, and grooves (2012*a,b*) being formed in said wall of said supporting cylinder adjacent said end of said base portion of each of said resilient fingers, whereby two tape stands can be connected together by inserting the resilient fingers of one tape stand into the slots of another tape stand.

2. The connectable tape stand according to claim 1, wherein said flanges are arcuate.

3. The connectable tape stand according to claim 1, wherein said flanges are in the shape of a triangle.

4. The connectable tape stand according to claim 1, wherein said grooves (2012*a*) are formed on both sides of each of said resilient fingers and said grooves extend axially into said supporting cylinder.

5. The connectable tape stand according to claim 1, wherein each of said resilient fingers extends beyond a plane formed by the free end of said protective wall for an axial distance greater than the thickness of said side wall of the tape stand, each flange has a bottom portion and each bottom portion abuts on the first side of said side wall when two tape stands are connected together.

6. The connectable tape stand according to claim 1, wherein each of said resilient fingers extend beyond a plane formed by the free end of said protective wall for an axial distance, said slots have a depth, said depth from said opposite side of said side wall being greater than said axial distance of said resilient fingers.

* * * * *